US007018235B1

(12) United States Patent
Burris et al.

(10) Patent No.: US 7,018,235 B1
(45) Date of Patent: Mar. 28, 2006

(54) COAXIAL CABLE CONNECTOR

(75) Inventors: Donald A. Burris, Peoria, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/012,507

(22) Filed: Dec. 14, 2004

(51) Int. Cl.
*H01R 9/05* (2006.01)

(52) U.S. Cl. ..... 439/584; 439/578; 439/675; 439/63

(58) Field of Classification Search ..... 439/578–585, 439/675, 63, 320, 310, 586–588, 275
See application file for complete search history.

(56) References Cited

U.S. PATENT DOCUMENTS

| | | | | |
|---|---|---|---|---|
| 3,634,815 | A | 1/1972 | Stevens et al. | 339/177 |
| 3,847,463 | A | 11/1974 | Hayward et al. | 339/8 |
| 3,963,320 | A | 6/1976 | Spinner | 339/177 |
| 3,985,418 | A | 10/1976 | Spinner | 339/177 |
| 4,156,554 | A | 5/1979 | Aujla | 339/177 |
| 4,280,749 | A | 7/1981 | Hemmer | 339/177 |
| 4,346,958 | A | 8/1982 | Blanchard | 339/177 |
| 4,583,811 | A | 4/1986 | McMills | 339/177 |
| 4,639,068 | A | 1/1987 | McMills et al. | 339/177 |
| 4,648,684 | A | 3/1987 | Mattis et al. | 339/177 |
| 4,674,818 | A | 6/1987 | McMills et al. | 439/275 |
| 4,676,577 | A | 6/1987 | Szegda | 439/584 |
| 4,717,355 | A | 1/1988 | Mattis | 439/452 |
| 4,755,152 | A | 7/1988 | Elliot et al. | 439/452 |
| 4,952,174 | A | 8/1990 | Sucht et al. | 439/584 |
| 5,011,432 | A | 4/1991 | Sucht et al. | 439/584 |
| 5,283,853 | A | 2/1994 | Szegda | 385/139 |
| 5,879,191 | A | 3/1999 | Burris | 439/584 |
| 5,975,951 | A | 11/1999 | Burris et al. | 439/585 |
| 5,997,350 | A * | 12/1999 | Burris et al. | 439/585 |
| 6,045,403 | A | 4/2000 | Werner et al. | 439/587 |
| 6,089,912 | A | 7/2000 | Tallis et al. | 439/584 |
| 6,331,123 | B1 * | 12/2001 | Rodrigues | 439/584 |
| 6,530,807 | B1 * | 3/2003 | Rodrigues et al. | 439/578 |
| 6,733,336 | B1 * | 5/2004 | Montena et al. | 439/578 |
| 6,783,394 | B1 * | 8/2004 | Holliday | 439/578 |
| 6,790,081 | B1 * | 9/2004 | Burris et al. | 439/578 |
| 6,805,584 | B1 * | 10/2004 | Chen | 439/578 |
| 6,848,939 | B1 | 2/2005 | Stirling | 439/578 |
| 6,884,113 | B1 * | 4/2005 | Montena | 439/578 |

FOREIGN PATENT DOCUMENTS

| | | |
|---|---|---|
| GB | 1051493 | 12/1966 |

OTHER PUBLICATIONS

2004 Corning Gilbert Inc. G-1400-662 Brochure entitled UltraRange™TM Series, Sep 2004.
Corning Gilbert Coaxial Connector, sold before the invention, 1 page cross-sectional view.

* cited by examiner

*Primary Examiner*—P. Austin Bradley
*Assistant Examiner*—Edwin A. Leon
(74) *Attorney, Agent, or Firm*—Joseph M. Homa

(57) ABSTRACT

A connector for coaxial cable is disclosed herein which has a gripping ring positioned between a compression ring and a connector body. At least two opposed ends of the gripping ring are capable of being displaced radially inwardly for gripping the cable. A related method is also disclosed.

44 Claims, 7 Drawing Sheets

COAXIAL CABLE CONNECTOR

BACKGROUND OF THE INVENTION

1. Field of the Invention

The present invention relates generally to coaxial cable connectors, and particularly to coaxial cable connectors capable of being connected to a terminal.

2. Technical Background

Coaxial cable connectors such as F-connectors are used to attach coaxial cable to another object such as an appliance or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is secured over the prepared end of the jacketed coaxial cable, allowing the end of the coaxial cable to be connected with a terminal block, such as by threadedly connection with a threaded terminal of a terminal block.

Crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable. An example of such crimp connectors is disclosed within U.S. Pat. No. 4,400,050 to Hayward.

It is known in the art that the passage of moisture between the coaxial cable jacket and the surrounding F-connector can lead to corrosion, increased contact resistance, reduced signal strength, and excessive RF leakage from the connector. Those skilled in the art have made various efforts to form a seal between the F-connector and the jacket of the coaxial cable to preclude such moisture ingress. F-connectors are known in the cable television industry wherein special sealing compounds are included in an effort to form leak-proof seals. For example, U.S. Pat. No. 4,755,152 to Elliot, et al., discloses a crimp connector incorporating a glob of a gel or other movable sealing material within a cavity of the connector to form a seal between the jacket of the coaxial cable and the interior of the F-connector.

Still another form of F-connector is known wherein an annular compression sleeve is used to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for following such compression sleeve to be passed over the end of the coaxial cable prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen; such patent discloses a compression sleeve type F-connector known in the industry as "Snap-n-Seal". A number of commercial tool manufacturers provide compression tools for axially compressing the compression sleeve into such connectors.

A somewhat related radial compression-type F-connector is disclosed within U.S. Pat. No. 5,470,257 to Szegda. A tubular locking member protrudes axially into the open rear end of the outer collar or sleeve. The tubular locking member is displaceable axially within the outer collar between an open position accommodating insertion of the tubular post into the prepared end of the coaxial cable, and a clamped position fixing the end of the cable within the F-connector. An O-ring is mounted on the rear end of the tubular locking member to seal the connection between the tubular locking member and the outer collar as the tubular locking member is axially compressed. Such connectors have been sold in the past under the designation "CMP". The O-ring provided on the tubular locking member is exposed and unprotected prior to axial compression of the F-connector.

It is known in the coaxial cable field generally that collars or sleeves within a coaxial cable connector can be compressed inwardly against the outer surface of a coaxial cable to secure a coaxial cable connector thereto. For example, in U.S. Pat. No. 4,575,274 to Hayward, a connector assembly for a signal transmission system is disclosed wherein a body portion threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, the connector shown in the Hayward '274 patent is much more expensive than conventional F-connectors and can not be installed quickly, as by a simple crimp or compression tool; rather, the mating threads of such connector must be tightened, as by using a pair of wrenches.

SUMMARY OF THE INVENTION

In one aspect, a connector is disclosed herein for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising: a hollow body comprising a rear end, a front end, and an internal surface extending between the rear and front ends of the body, the internal surface defining a longitudinal hole; a compression ring comprising a rear end, a front end surrounding the hollow body, and an inner surface defining a longitudinal hole extending between the rear and front ends of the compression ring; a tubular post disposed at least partially within the longitudinal hole of the hollow body, the post comprising a tubular shank having a rear end, an inner surface and an outer surface, and wherein the outer surface of the tubular shank and the internal surface of the body define an annular cavity therebetween; and a deformable gripping ring disposed between the hollow body and the inner surface of the compression ring, the gripping ring comprising a rear end, a front end, an outer surface, and an inner surface. The compression ring is axially movable over the hollow body between a rearward position and a forward position. In the rearward position, the inner surface at the rear end of the gripping ring has a rear inner diameter, and the inner surface at the front end of the gripping ring has a front inner diameter. In the forward position, the gripping ring is compressed between the hollow body and the compression ring, the rear end of the gripping ring has a reduced rear inner diameter less than the rear inner diameter, and the front end of the gripping ring has a reduced front inner diameter less than the second front diameter. Preferably, the connector further comprises a coupler disposed proximate the front end of the body.

In some preferred embodiments, the front inner diameter and rear inner diameter of the gripping ring are substantially equal in the rearward position. In other preferred embodiments, the front inner diameter and the rear inner diameter of the gripping ring are not equal in the forward position.

Preferably, the gripping ring is concentrically mounted to the inner surface of the compression ring. In preferred embodiments, the gripping ring is mounted onto the inner surface of the compression ring by press fit. In other preferred embodiments, the gripping ring is mounted onto the inner surface of the compression ring by adhesive. In still other preferred embodiments, the gripping ring is not attached to the compression ring. Preferably, in the forward position, at least a portion of the gripping ring is disposed within the annular cavity. Preferably, at least a portion of the gripping ring is displaced radially outwardly as the compression ring is axially moved over the hollow body in the forward position.

The gripping ring is most preferably circumferentially continuous. Preferably, the gripping ring forms a continuous 360° seal in the forward position.

In the forward position, the inner surface of the gripping ring preferably, from the rear end to the front end thereof, contacts the jacket of the cable. Preferably, in the forward position, substantially all of the inner surface of the gripping ring contacts the jacket of the cable. Preferably, the compressive force applied by the gripping ring to the cable is sufficient to leave an indented footprint of the gripping ring on the jacket.

In the forward position, the gripping ring preferably forms a seal between the rear end of the hollow body and the compression ring. Preferably, the gripping ring is axially offset from the rear end of the tubular shank in the rearward position. Preferably, the front end of the gripping ring is axially offset from the rear end of the hollow body in the rearward position. Preferably, the front end of the gripping ring contacts the rear end of the hollow body in the forward position. In preferred embodiments, the rear end of the shank projects rearwardly past the rear end of the body. Preferably, at least a portion of the gripping ring surrounds at least a portion of the shank in the forward position.

In the forward position, the gripping ring preferably forms at least one seal, more preferably at least two seals, and even more preferably at least three seals inside the connector.

The inner surface of the compression ring preferably comprises a forward facing tapered portion configured to displace the rear end of the gripping ring radially inwardly. Preferably, the hollow body comprises a tubular sleeve having a rear end which forms the rear end of the body, wherein the rear end of the sleeve comprises a rearward facing tapered portion configured to displace the front end of the gripping ring radially inwardly.

The gripping ring is preferably axially offset from the rearward facing tapered portion in the rearward position. Preferably, the gripping ring contacts the rearward facing tapered portion in the forward position.

In preferred embodiments, the inner surface of the compression ring comprises a forward facing tapered portion configured to displace the rear end of the gripping ring radially inwardly.

Preferably, the gripping ring is axially offset from the forward facing tapered portion in the rearward position. The gripping ring preferably contacts the forward facing tapered portion in the forward position.

In preferred embodiments, the outer surface of the tubular post at or near the rear end comprises at least one raised ridge or a plurality of raised ridges. Preferably, the gripping ring is axially offset from the raised ridge in the rearward position. Preferably, at least part of the gripping ring surrounds the raised ridge in the forward position.

In another aspect, a connector is disclosed herein for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising: a hollow body comprising a rear end, a front end, and an internal surface extending between the rear and front ends of the body, the internal surface defining a longitudinal hole; a compression ring comprising a rear end, a front end surrounding the hollow body, and an inner surface defining a longitudinal hole extending between the rear and front ends of the compression ring; a tubular post disposed at least partially within the longitudinal hole of the hollow body, the post comprising a tubular shank having a rear end, an inner surface and an outer surface, and wherein the outer surface of the tubular shank and the internal surface of the body define an annular cavity therebetween, wherein the inner surface is configured to allow the dielectric and the inner conductor to enter the shank and to allow the braided shield and the jacket to enter the annular cavity; and a deformable gripping ring disposed between the hollow body and the inner surface of the compression ring, the gripping ring comprising a rear end, a front end, an outer surface, and an inner surface; wherein the cable extends through the compression ring, through the gripping ring, and into the hollow body. The rear end of the shank is disposed between the braided shield and the dielectric, and part of the jacket and part of the braided shield are disposed in the annular cavity. The compression ring is axially movable over the hollow body between a rearward position and a forward position. In the rearward position, the inner surface at the rear end of the gripping ring has a rear inner diameter, and the inner surface at the front end of the gripping ring has a front inner diameter. In the forward position, the gripping ring is deformed by compression between the hollow body and the compression ring, the rear end of the gripping ring is displaced radially inwardly sufficient to reduce the rear inner diameter and to place the rear end of the gripping ring into contact with the jacket, and the front end of the gripping ring is displaced radially inwardly sufficient to reduce the front inner diameter and to place the front end of the gripping ring into contact with the jacket, wherein the jacket is sandwiched between the gripping member and the shank.

Preferably, the gripping ring is deformed such that it is displaced radially inwardly sufficiently to deform the jacket in the forward position. Preferably, the gripping ring forms a seal between the hollow body and the jacket in the forward position.

Preferably, the gripping ring forms a seal between the compression ring and the jacket in the forward position. Preferably, the gripping ring forms a seal between the compression ring and the hollow body in the forward position. In preferred embodiments, in the forward position, the gripping ring forms a seal simultaneously between the hollow body and the jacket. between the compression ring and the jacket, and between the compression ring and the hollow body.

Preferably, the inner surface of the gripping ring does not contact the jacket in the rearward position. Preferably, in the forward position, the inner surface of the gripping ring, from the rear end to the front end thereof, contacts the jacket of the cable. Preferably, in the forward position, substantially all of the inner surface of the gripping ring contacts the jacket of the cable.

In preferred embodiments, in the rearward position, the end of the coaxial cable is disposed within the connector, wherein at least part of the inner conductor and at least part of the dielectric are disposed within the tubular shank, and wherein at least part of the outer conductor and at least part of the jacket are disposed in the annular cavity.

Preferably, in the forward position, at least a portion of the jacket and at least a portion of the outer conductor are sandwiched between the gripping member and the rear end of the tubular shank.

Preferably, in the forward position, the gripping member forms a seal between the jacket and the rear end of the hollow body, thereby sealing the annular cavity at the rear end of the hollow body. Preferably, in the forward position, the gripping member forms a seal between the jacket and the inner surface of the compression ring. Preferably, in the forward position, the gripping member forms a seal between the hollow body and the inner surface of the compression ring.

In yet another aspect, disclosed herein is a combination of a coaxial cable and a connector for coupling an end of the coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising: a hollow body comprising a rear end, a front end, and an internal surface extending between the rear and front ends of the body, the internal surface defining a longitudinal hole; a compression ring comprising a rear end, a front end surrounding the hollow body, and an inner surface defining a longitudinal hole extending between the rear and front ends of the compression ring; a tubular post disposed at least partially within the longitudinal hole of the hollow body, the post comprising a tubular shank having a rear end, an inner surface and an outer surface, and wherein the outer surface of the tubular shank and the internal surface of the body define an annular cavity therebetween, wherein the inner surface is configured to allow the dielectric and the inner conductor to enter the shank and to allow the braided shield and the jacket to enter the annular cavity; and a deformable gripping ring disposed between the hollow body and the inner surface of the compression ring, the gripping ring comprising a rear end, a front end, an outer surface, and an inner surface. The cable extends through the compression ring, through the gripping ring, and into the hollow body, wherein the rear end of the shank is disposed between the braided shield and the dielectric, and part of the jacket and part of the braided shield are disposed in the annular cavity. The compression ring is axially movable over the hollow body between a rearward position and a forward position. In the rearward position, the inner surface at the rear end of the gripping ring has a rear inner diameter, and the inner surface at the front end of the gripping ring has a front inner diameter. In the forward position, the gripping ring is deformed by compression between the hollow body and the compression ring, the rear end of the gripping ring is displaced radially inwardly sufficient to reduce the rear inner diameter and to place the rear end of the gripping ring into contact with the jacket, and the front end of the gripping ring is displaced radially inwardly sufficient to reduce the front inner diameter and to place the front end of the gripping ring into contact with the jacket, wherein the jacket is sandwiched between the gripping member and the shank.

In another aspect, a method of coupling a coaxial cable to a terminal is disclosed herein, the coaxial cable comprising an inner conductor, a dielectric surrounding the inner conductor, an outer conductor surrounding the dielectric, a braided shield surrounding the dielectric, and a jacket surrounding the braided shield, the method comprising: (a) providing a connector comprising a hollow body, a compression ring disposed around a portion of the hollow body, a tubular post at least partially disposed within the hollow body, and a deformable gripping ring disposed between the compression ring and the hollow body, the gripping ring having a rear end and a front end; (b) inserting the cable into the compression ring until the tubular post is driven into the cable; and (c) moving the compression ring and the hollow body together to deform the deformable gripping ring and to displace both the front end and the rear end of the gripping ring radially inwardly sufficient to sandwich the jacket between the gripping ring and the tubular post. Preferably, the connector further comprises a coupler disposed around the hollow body, and the coupler engages the terminal after step (c).

Accordingly, a simple and inexpensive connector is disclosed herein that can easily be machined from a small number of components, and which can be quickly installed over the prepared end of a coaxial cable, for example by using a conventional axial compression installation tool. The connector preferably forms a reliable moisture proof seal between the connector and the jacket of the coaxial cable to preclude moisture from passing between the connector and the jacket of the coaxial cable extending therein. Preferably, the connector disclosed herein avoids the need for gels or other sealing compounds, although gels or other sealing compounds could be provided for additional strength and/or sealing. Furthermore, the connector disclosed herein provides a connector or connector/coaxial cable assembly or method which results in a pull-out strength which reduces dislodgement of the cable from the connector following installation.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
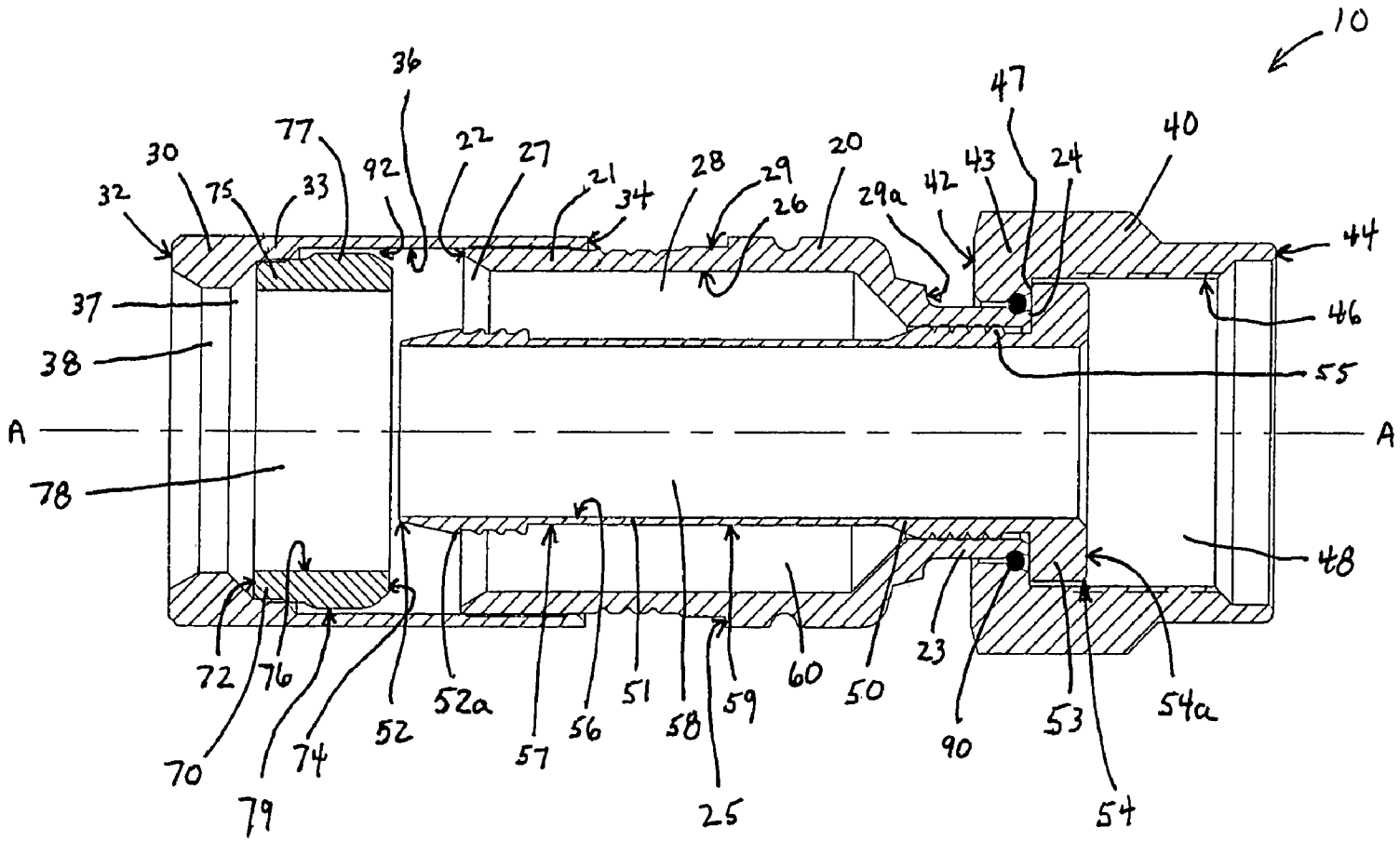
FIG. 1 is a side cutaway view along the centerline of one preferred embodiment of a connector, as disclosed herein, comprising a compression ring in a rearward position.

Reference will now be made in detail to the present preferred embodiment(s) of the invention, examples of which are illustrated in the accompanying drawings. Whenever possible, the same reference numerals will be used throughout the drawings to refer to the same or like parts. One embodiment of the present invention is shown in FIG. 1, and is designated generally throughout by the reference numeral 10.

Figure 2:
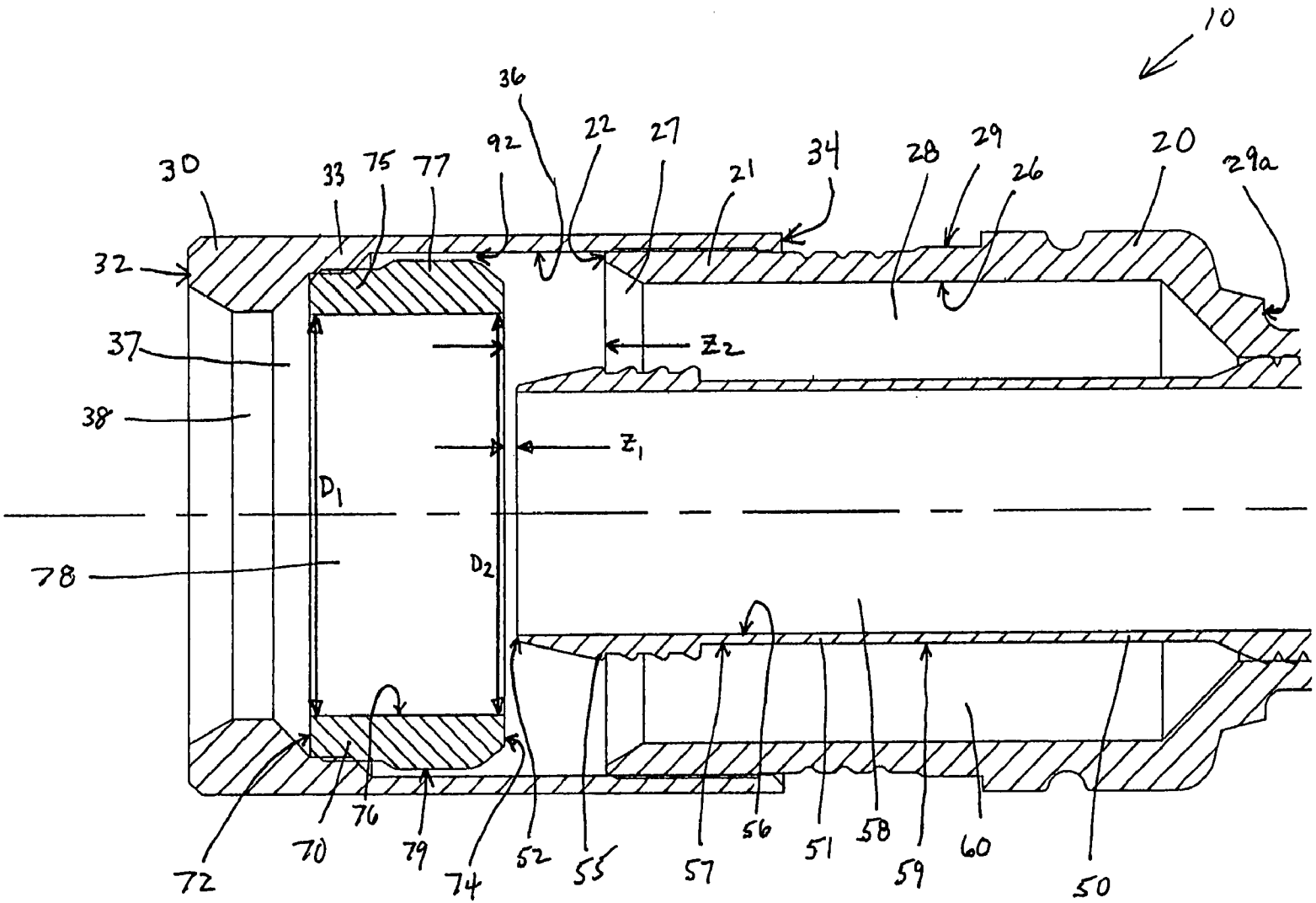
FIG. 2 is an enlarged view of part of the connector of FIG. 1.
Figure 3:
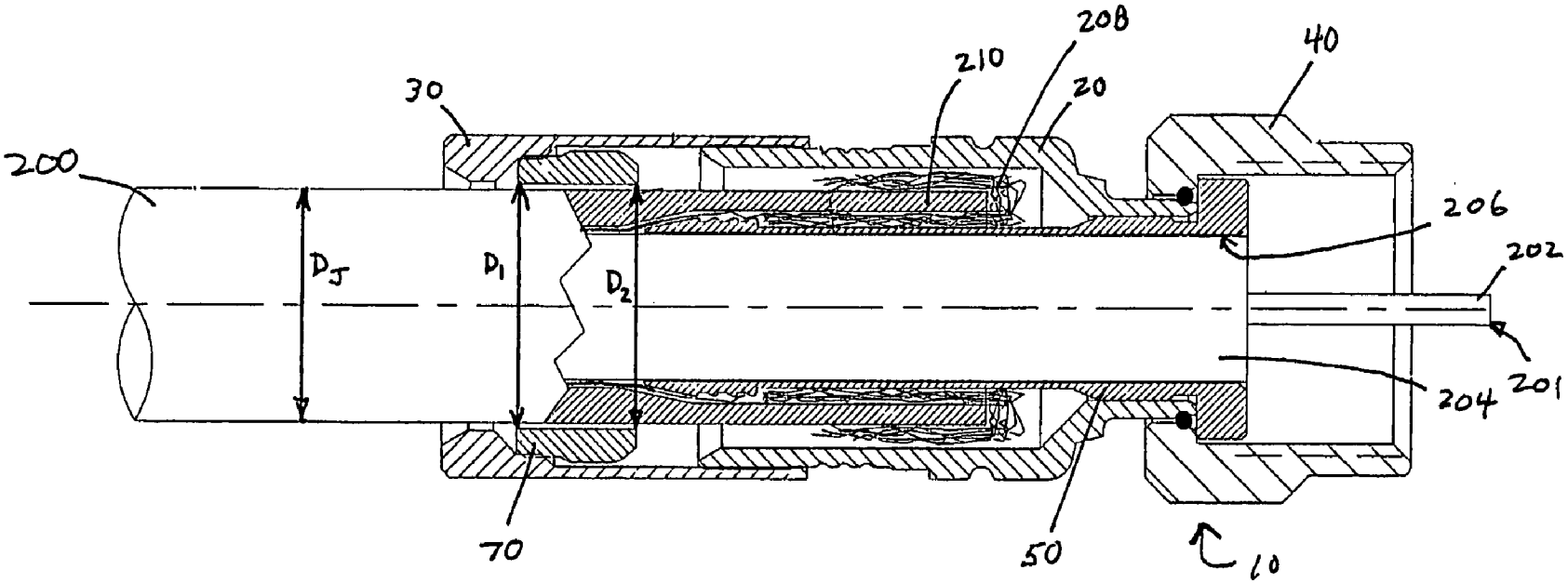
FIG. 3 is a partial side cutaway view of a coaxial cable shown inserted into the connector of FIG. 1 in side cutaway view.
Figure 4:
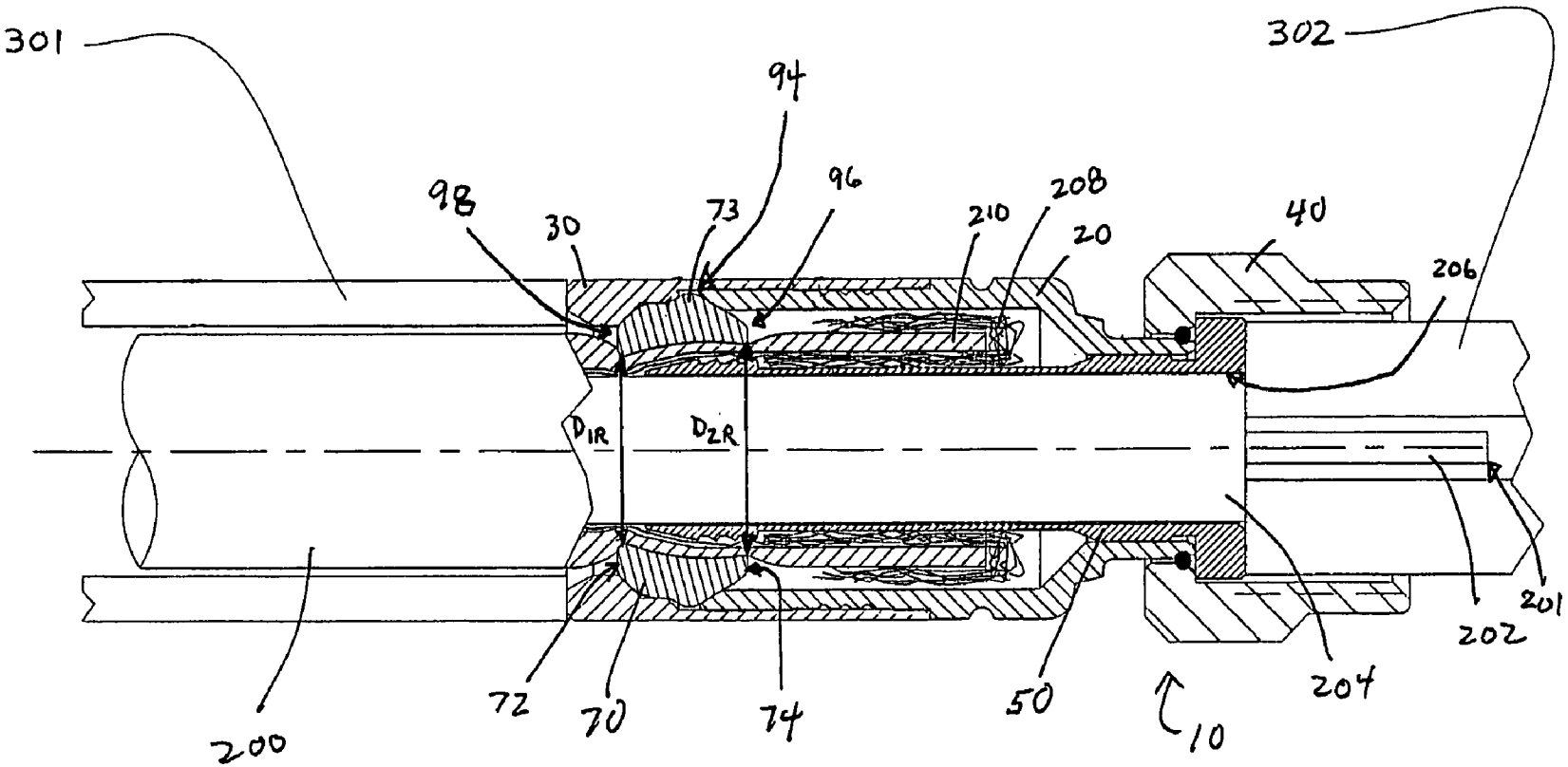
FIG. 4 is a side cutaway view of the connector of FIG. 1 with a partial view of tool used to compress the connector such that the compression ring is in a forward position.
Figure 5:
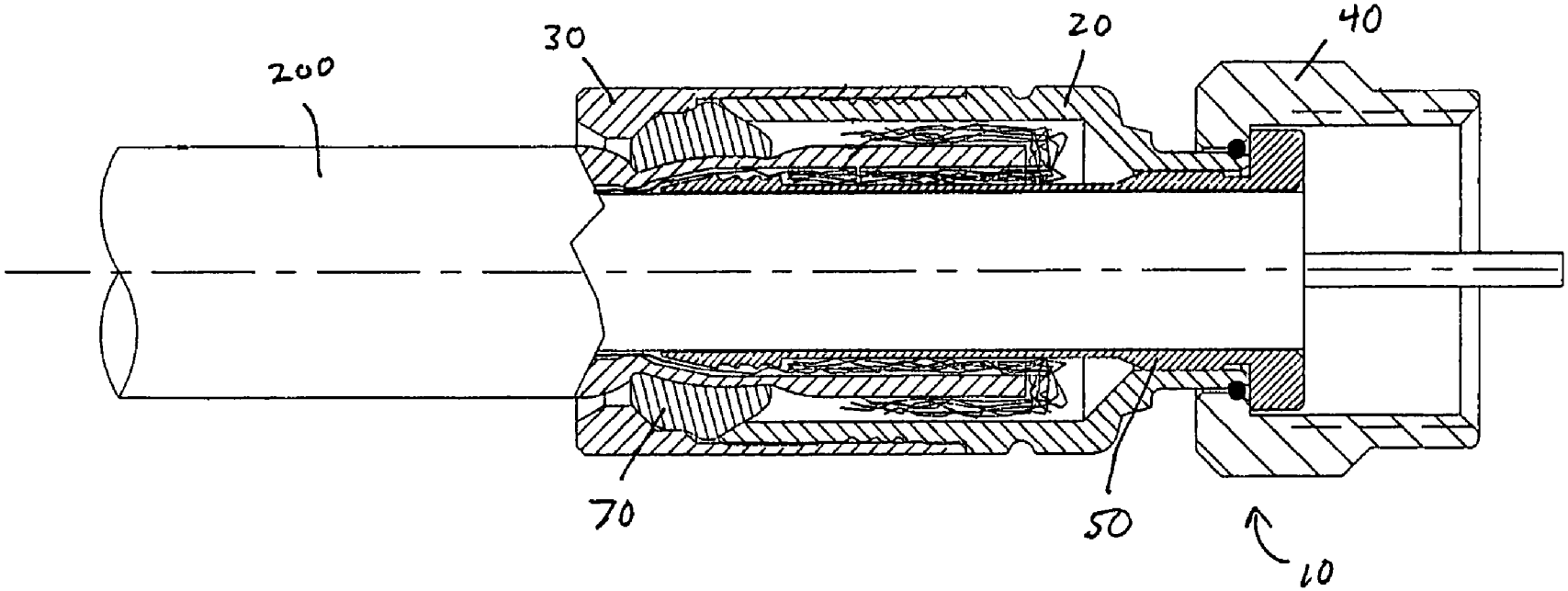
FIG. 5 is a side cutaway view of the connector and cable of FIG. 4 after the tool has been removed and the compression ring is in the forward position.
Figure 6:
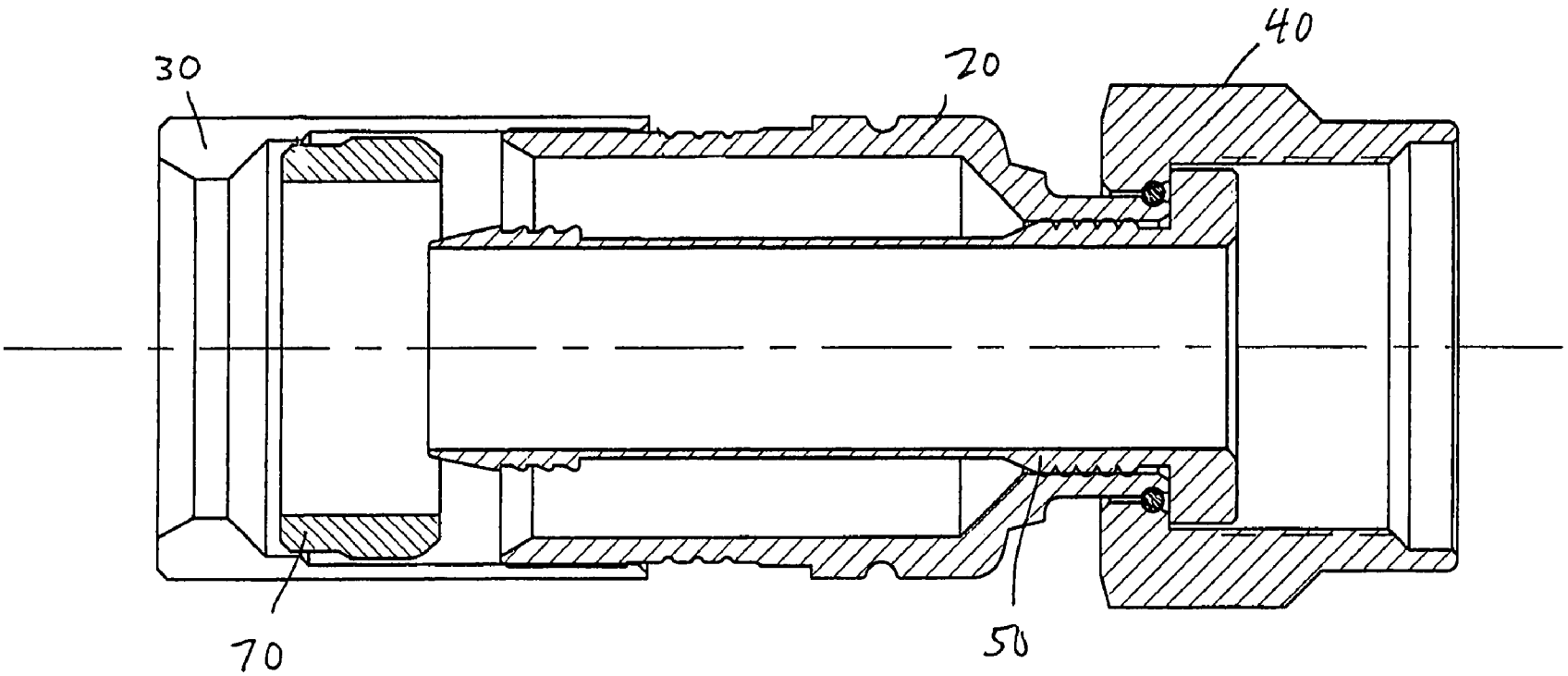
FIG. 6 is a side cutaway view of another preferred embodiment of a connector as disclosed herein comprising a gripping ring which is not fixedly attached to the compression ring.
Figure 7:
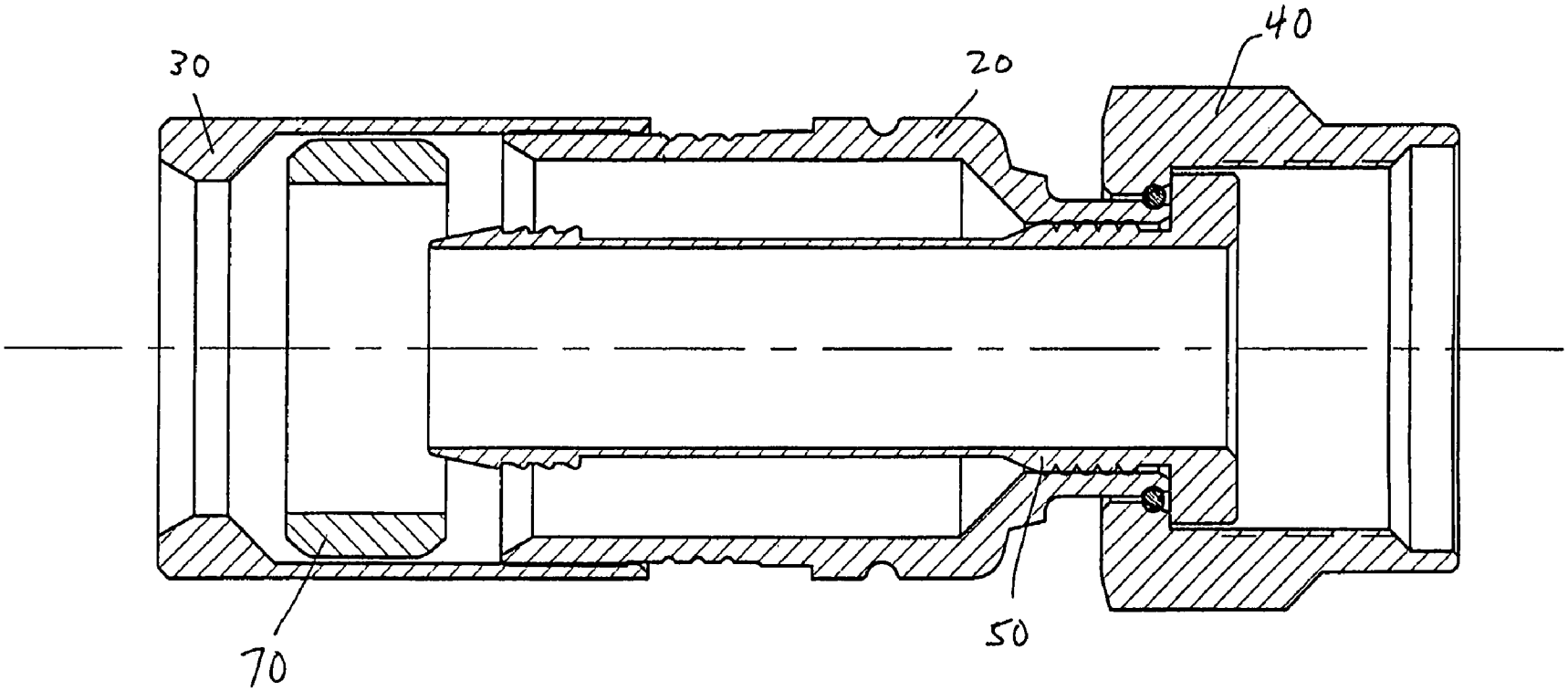
FIG. 7 is a side cutaway view of still another preferred embodiment of a connector as disclosed herein comprising a gripping ring which is not fixedly attached to the compression ring.

FIG. 1 schematically illustrates one preferred embodiment of a connector, as disclosed herein, comprising a compression ring in a rearward position. FIG. 2 is an enlarged view of FIG. 1. FIG. 3 schematically illustrates a coaxial cable inserted into the connector of FIG. 1, or, alternatively, the connector inserted onto the cable. FIG. 4 schematically illustrates the connector of FIG. 1 in conjunction with two portions of a tool used to compress the connector together such that the compression ring moves into a forward position, wherein the connector is shown in FIG. 4 in a position just prior to removal of the tool therefrom. FIG. 5 schematically illustrates the connector and cable after the tool has been removed and the compression ring is in the forward position. FIG. 6 schematically illustrates another preferred embodiment of a connector as disclosed herein comprising a gripping ring which is not fixedly attached to the compression ring. FIG. 7 schematically illustrates still another preferred embodiment of a connector as disclosed herein comprising another gripping ring which is not fixedly attached to the compression ring.

Referring to FIG. 1, the connector 10 has a central longitudinal axis A—A.

FIGS. 1–5 show a connector 10 for coupling an end of a coaxial cable 200 to a terminal. The coaxial cable 200 shown in FIG. 2 comprises an inner conductor 202, a dielectric layer (or, simply, dielectric) 204 surrounding the inner conductor 202, an outer conductor 206 surrounding the dielectric 204, a braided shield 208 surrounding the dielectric 204, and a jacket 210 surrounding the braided shield 208.

Referring to FIG. 1, the connector 10 comprises a hollow body 20, a compression ring 30 disposed at the rear end of the body 20, a coupler 40 disposed at or near or proximate the front end of the body 20, a tubular post 50 disposed at least partially within the hollow body 20, and a deformable gripping ring 70 disposed between the hollow body 20 and the compression ring 30. Gripping ring 70 is made of a deformable material, such as plastic, for example acetal, or such as soft metal or alloy, for example lead. Preferably, body 20, compression ring 30, and coupler 40 are made from a corrosion resistant material, for example nickel plated brass. Post50 is made from electrically conductive material, preferably metal, for example tin-plated brass.

The hollow body 20 comprises a rear end 22, a front end 24, and an internal surface 26 extending between the rear and front ends 22, 24 of the body 20, the internal surface 26 defining a longitudinal hole 28.

The compression ring 30 comprises a rear end 32, a front end 34 surrounding and contacting the hollow body 20, and an inner surface 36 defining a longitudinal hole 38 extending between the rear and front ends 32, 34 of the compression ring 30.

The tubular post 50 is disposed at least partially within the longitudinal hole 28 of the hollow body 20, the post 50 comprising an outer surface 59 and an inner surface 56, wherein the post 50 comprises a head flange 53 and a tubular shank 51 having a rear end 52, an inner surface 56 and an outer surface 57, wherein at least the rear end 52 is disposed within the longitudinal hole 28 of the body 20, and wherein the outer surface 57 of the tubular shank 51 and the internal surface 26 of the body 20 define an annular cavity 60 therebetween. The inner surface 56 defines a longitudinal hole 58 extending from the rear end 52 to the front end 54.

The deformable gripping ring 70 is disposed between the hollow body 20 and the inner surface 36 of the compression ring 30, the gripping ring 70 comprising a rear end 72 facing the rear end 32 of the compression ring 30, a front end 74 facing the hollow body 20, an outer surface 79 for contacting the inner surface 36 of the compression ring 30, and an inner surface 76 defining a longitudinal hole 78.

The compression ring 30 is axially moveable over the hollow body 20 between a rearward position (FIGS. 1, 2 and 3) and forward position (FIGS. 4 and 5). Referring to FIG. 2, in the rearward position, the inner surface 76 at the rear end 72 of the gripping ring 70 has a rear inner diameter D1, and the inner surface 76 at the front end 74 of the gripping ring 70 has a front inner diameter D2. Referring to FIG. 4, in the forward position, the gripping ring 70 is compressed between the hollow body 20 and the inner surface 36 of the compression ring 30, the rear end 72 of the gripping ring 70 has a reduced rear inner diameter D1R which is less than the rear inner diameter D1, and the front end 74 of the gripping ring 70 has a reduced front inner diameter D2R which is less than the front inner diameter D2. Both the rear and front ends 72, 74 of the gripping ring 70 are displaced radially inwardly in the forward position. In some preferred embodiments, the front inner diameter D2 and rear inner diameter D1 of the gripping ring 70 are substantially equal in the rearward position. In other preferred embodiments, the front inner diameter D2 and the rear inner diameter D1 of the gripping ring 70 are not equal in the forward position. In some preferred embodiments, the gripping ring 70 has a substantially constant inner diameter in the rearward position. Preferably, the gripping ring 70 is concentrically mounted to the internal surface 26 of the compression ring 30. Preferably, the rear end 72 of the gripping ring 70 is attached to the inner surface 36 of the compression ring 30. In preferred embodiments, the rear end 72 of the gripping ring 70 is press fit with the inner surface 36 of the compression ring 30, i.e. the gripping ring 70 is mounted onto the surface 26 of the compression ring 30 by press fit. In other preferred embodiments, the gripping ring 70 is mounted onto the inner surface 36 of the compression ring 30 by adhesive. In other embodiments, the gripping ring 70 is not attached to the compression ring 30, i.e. the gripping ring 70 is disposed loosely within the longitudinal hole 38 of the compression ring 30, for example as illustrated in FIGS. 6 and 7. Preferably, the gripping ring 70 moves axially along with the compression ring 30 between the rearward and forward positions. Preferably, the gripping ring 70 moves axially with respect to the tubular sleeve 21 between the rearward and forward positions.

As seen in FIG. 4, in the forward position, at least a portion of the gripping ring 70 is disposed within the annular cavity 60. In some preferred embodiments, at least a portion of the gripping ring 70 is displaced radially outwardly (e.g. as at 73 in FIG. 4) as the compression ring 30 is axially moved over the hollow body 20 in the forward position.

The gripping ring 70 is circumferentially continuous, i.e. 360 degrees continuous about a centerline axis, A—A. Although the gripping ring 70 is deformed in the forward position, the gripping ring 70 forms a continuous 360 degree seal in the forward position. Preferably, in the forward position, the inner surface 76 of the gripping ring 70, from the rear end 72 to the front end 74 thereof, contacts the jacket 210 of the cable 200. Preferably, in the forward position, substantially all of the inner surface 76 of the gripping ring 70 contacts the jacket 210 of the cable 200. Preferably, in the forward position the gripping ring 70 forms a seal between the rear end 22 of the hollow body 20 and the inner surface 36 of the compression ring 30.

The gripping ring 70 is preferably axially offset, as at Z1 in FIG. 2, from the rear end 52 of the tubular shank 51 in the rearward position. Preferably the front end 74 of the gripping ring 70 is axially offset from the rear end 52 of the tubular shank 51 in the rearward position. The gripping ring 70 is preferably axially offset, as at Z2 in FIG. 2, from the rear end 22 of the hollow body 20 in the rearward position.

Preferably the front end 74 of the gripping ring 70 contacts the rear end 22 of the hollow body 20 in the forward position. Preferably, the rear end 52 of the shank 51 projects rearwardly past the rear end 22 of the body 20. As seen in FIGS. 1–7, the rear end 52 of the shank 51 extends from the front end 24 of the body 20 to at least the rear end 22 of the body 20. In preferred embodiments, at least a portion of the gripping ring 70 surrounds at least a portion of the shank 51 in the forward position.

The hollow body 20 comprises a tubular sleeve 21 having a rear end 22 which forms the rear end 22 of the body 20, wherein the rear end 22 of the sleeve 21 comprises a rearward facing tapered portion 27 configured to displace the front end of the gripping ring 70 radially inwardly. Preferably, the gripping ring 70 is axially offset from the rearward facing tapered portion 27 in the rearward position, as at Z2 in FIG. 2. Preferably, the gripping ring 70 contacts the rearward facing tapered portion 27, which further preferably displaces the front end 74 of the gripping ring 70 radially inwardly, in the forward position.

The inner surface 36 of the compression ring 30 preferably comprises a forward facing tapered portion 37 configured to displace the rear end 72 of the gripping ring 70 radially inwardly. Preferably, the gripping ring 70 does not contact the forward facing tapered portion 37 in the rearward position. Preferably, the gripping ring 70 contacts the forward facing tapered portion 37 and displaces the rear end of the gripping ring 70 radially inwardly in the forward position.

In the rearward position, the end 201 of the coaxial cable 200 is disposed within the connector 10, wherein at least part of the inner conductor 202 and at least part of the dielectric 204 are disposed within the tubular shank 51, and wherein at least part of the braided shield 208 and at least part of the jacket 210 are disposed in the annular cavity 60. Preferably, in the forward position, at least a portion of the jacket 210 and at least a portion of the outer conductor 206 are sandwiched between the gripping ring 70 and the rear end 52 of the tubular shank 51. Preferably, in the forward position, the gripping ring 70 forms a seal between the jacket 210 and the rear end 22 of the hollow body 20, thereby sealing the annular cavity 60 at the rear end 22 of the hollow body 20, as at 96 in FIG. 4. Preferably, in the forward position, the gripping ring 70 forms a seal between the jacket 210 and the inner surface 36 of the compression ring 30, as at 98 in FIG. 4. Preferably, in the forward position, the gripping ring 70 forms a seal between the hollow body 20 and the inner surface 36 of the compression ring 30, as at 94 in FIG. 4. Most preferably, in the forward position, the gripping ring 70 simultaneously forms a seal: (1) between the jacket 210 and the rear end of the hollow body 20, thereby sealing the annular cavity 60 at the rear end of the hollow body 20; (2) between the jacket 210 and the inner surface of the compression ring 30; and (3) between the hollow body 20 and the inner surface of the compression ring 30. In some embodiments, the compression ring 30, the gripping ring 70, and the body 50 are configured such that the gripping ring 70 deforms and entirely fills the space bounded by the compression ring, the rear end 52 of the shank 52, and the jacket 210 of the cable 200 in the forward position, for example akin to a blivet, i.e. the gripping ring fills the space bounded between the sealed-off areas 94, 96, 98 as seen in FIG. 4.

The outer surface 59 of the tubular post 50 at or near the rear end 52 thereof preferably comprises a raised ridge 52*a* Preferably, the gripping ring 70 is axially offset from the raised ridge 52*a* in the rearward position. Preferably, at least part of the gripping ring 70 surrounds the raised ridge 52*a* in the forward position. In preferred embodiments, the outer surface 59 of the tubular post 50 at or near the rear end 52 thereof comprises a plurality of raised ridges 52*a* as seen, for example, in FIGS. 1–7.

Preferably, the head flange 53 of the tubular post 50 is not disposed within the hollow body 20. Preferably, the front end 24 of the hollow body 20 comprises a neck 23, wherein the front end 24 of the hollow body 20 at the neck 23 is configured to axially engage the head flange 53 of the post 50, thereby preventing the head flange 53 from entering the longitudinal hole 28 of the hollow body 20.

In preferred embodiments, the coupler 40 comprises a rear end 42, a front end 44 for engaging a terminal, an inner surface 46 defining a longitudinal hole 48 extending from the rear end 42 to the front end 44, such that at least a portion of the end of the cable can project into the longitudinal hole 48.

In one preferred embodiment, the coupler 40 comprises an inner surface 46 which is at least partially threaded for threadedly engaging a threaded port, wherein the coupler 40 may be referred to as a nut. The rear end 42 of the coupler 40 comprises a tail flange 43 configured to surround at least a portion of the neck 23 of the body 20. The tail flange 43 comprises a forward facing portion 47 configured to axially engage the head flange 53 of the post 50, thereby preventing the coupler 40 from axially sliding off the front end 24 of the body 20. The outer surface 29 of the hollow body 20 preferably comprises an external shoulder 29*a* disposed rearward of the neck 23, wherein the shoulder 29*a* is configured to axially engage the rear end 42 of the coupler 40, thereby preventing the coupler 40 from axially sliding off the rear end 22 of the body 20. An O-ring 90 is preferably disposed between the neck 23, the head flange 53 of the post 50, and the tail flange 43 of the coupler 40. Prior to engaging the coupler 40 (and therefore the connector) to a terminal, the tail flange 43 is rotatably mounted around the neck 23, and preferably the coupler 40 is freely rotatable around the neck 23. Preferably, the tubular post 50 is fixedly attached to the hollow body 20; in preferred embodiments, the post 50 is attached to the body 20 by press fit, wherein the outer surface 59 of the post 50 preferably is configured for press fit with the internal surface 26 of the hollow body 20 at the neck 23, wherein the outer surface 59 of the post 50 preferably comprises a plurality of ridges 55 for engaging the internal surface 26 of the hollow body 20 at the neck 23. In other embodiments, the tubular post and the hollow body are formed as a unitary hollow body.

Preferably, the inner surface 36 of the compression ring 30 comprises a reduced inner diameter portion 33, such that at least a portion of the gripping ring 70 is mounted on the reduced inner diameter portion 33. In some preferred embodiments, the outer surface 79 of the gripping ring 70 comprises a reduced outer diameter 75 portion mounted on the reduced inner diameter portion 33 of the inner surface 36 of the compression ring 30. In some preferred embodiments, the inner surface 36 of the compression ring 30 further comprises an increased outer diameter portion 77 adjacent the reduced outer diameter portion 75, wherein the increased outer diameter portion 77 and the inner surface 36 of the compression ring 30 define an annular space 92 therebetween in the rearward position. Preferably, at least a portion of the gripping ring 70 fills at least a portion of the annular space 92 in the forward position.

FIGS. 6–7 show other preferred embodiments of a connector disclosed herein wherein the gripping ring is not attached to the inner surface of the compression ring, i.e. the gripping ring is loosely disposed inside the connector.

FIG. 7 a connector having a compression ring that does not have a reduced inner diameter portion (such as at 33 in the embodiment of FIGS. 1 and 2) on which the gripping ring 70 is mounted. The gripping ring in FIG. 7 has substantially constant inner diameter and a substantially constant outer diameter over the majority (>50%) of its axial length.

In use, the end 201 of a coaxial cable 200 is brought together with the rear end of the connector 10, i.e. the rear end 32 of compression ring 30, such that the cable 200 enters the longitudinal hole 38 of the compression ring 30, passes through the longitudinal hole 78 of the gripping ring 70, and is impaled upon the rear end 52 of the shank 51 of the tubular post 50. The rear end 52 of the shank 51 is driven between the braided shield 208 and the outer conductor 206 of the cable 200, preferably until the dielectric 204 at the end 201 of the cable 200 is flush with the distal surface 54*a* of the end 54 of the post 50, as illustrated in FIG. 3. The compression ring 30 and the tubular post 50 are then moved axially together, such as by implementation of a tool having first and second driving members 301, 302 which engage the rear end 32 of the compression ring 30 and the head 53 of the tubular post 50, respectively, as illustrated in FIG. 4. The compressive force generated by the first and second members 301, 302 axially moves the front end 34 of the compression ring 30 over the sleeve 21 of the hollow body 20, preferably until the front end 34 of the compression ring 30 engages shoulder 25 on the outer surface of the hollow body 20, thereby deforming the gripping ring 70 such that the front and rear ends 72, 74 of the gripping ring 70 are deflected radially inwardly against the jacket 210 of the cable 200. Preferably, the jacket 210 is sandwiched between the gripping ring 70 and the rear end 52 of the shank 51 of the tubular post 50. With the connector 10 attached to the end 201 of the cable 200, the connector 10 can then be placed into contact with a terminal such as a threaded terminal. The coupler 40 may be tightened onto the threaded terminal for electrical and mechanical coupling of the coaxial cable 200 to the terminal via the coaxial connector 10. As the coupler 40 is rotated to engage the threads of the coupler 40 and the terminal, ring 90 is compressed to form a seal.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a hollow body comprising a rear end, a front end, and an internal surface extending between the rear and front ends of the body, the internal surface defining a longitudinal hole;

a compression ring comprising a rear end, a front end surrounding the hollow body, and an inner surface defining a longitudinal hole extending between the rear and front ends of the compression ring;

a tubular post disposed at least partially within the longitudinal hole of the hollow body, the post comprising a tubular shank having a rear end, an inner surface and an outer surface, and wherein the outer surface of the tubular shank and the internal surface of the body define an annular cavity therebetween; and a deformable gripping ring disposed between the hollow body and the inner surface of the compression ring, the gripping ring comprising a rear end, a front end, an outer surface, and an inner surface;

wherein the compression ring is axially movable over the hollow body between a rearward position and a forward position;

wherein, in the rearward position, the inner surface at the rear end of the gripping ring has a rear inner diameter, and the inner surface at the front end of the gripping ring has a front inner diameter; and wherein, in the forward position, the gripping ring is compressed between the hollow body and the compression ring, the rear end of the gripping ring has a reduced rear inner diameter less than the rear inner diameter, and the front end of the gripping ring has a reduced front inner diameter less than the second front diameter.

2. The connector of claim 1 further comprising a coupler disposed proximate the front end of the body.

3. The connector of claim 1 wherein the front inner diameter and rear inner diameter of the gripping ring are substantially equal in the rearward position.

4. The connector of claim 1 wherein the gripping ring is not attached to the compression ring.

5. The connector of claim 1 wherein, in the forward position, at least a portion of the gripping ring is disposed within the annular cavity.

6. The connector of claim 1 wherein at least a portion of the gripping ring is displaced radially outwardly as the compression ring is axially moved over the hollow body in the forward position.

7. The connector of claim 1 wherein the gripping ring is circumferentially continuous.

8. The connector of claim 1 wherein the gripping ring forms a continuous 360° seal in the forward position.

9. The connector of claim 1 wherein, in the forward position, the inner surface of the gripping ring, from the rear end to the front end thereof, contacts the jacket of the cable.

10. The connector of claim 1 wherein, in the forward position, substantially all of the inner surface of the gripping ring contacts the jacket of the cable.

11. The connector of claim 1 wherein, in the forward position, the gripping ring forms a seal between the rear end of the hollow body and the compression ring.

12. The connector of claim 1 wherein the gripping ring is axially offset from the rear end of the tubular shank in the rearward position.

13. The connector of claim 1 wherein the front end of the gripping ring is axially offset from the rear end of the tubular shank in the rearward position.

14. The connector of claim 1 wherein the front end of the gripping ring contacts the rear end of the hollow body in the forward position.

15. The connector of claim 1 wherein the rear end of the shank projects rearwardly past the rear end of the body.

16. The connector of claim 1 wherein at least a portion of the gripping ring surrounds at least a portion of the shank in the forward position.

17. The connector of claim 1 wherein the outer surface of the tubular post at or near the rear end comprises a plurality of raised ridges.

18. The connector of claim 1 wherein the gripping ring is concentrically mounted to the inner surface of the compression ring.

19. The connector of claim 18 wherein the gripping ring is mounted onto the inner surface of the compression ring by press fit.

20. The connector of claim 18 wherein the gripping ring is mounted onto the inner surface of the compression ring by adhesive.

21. The connector of claim 1 wherein the hollow body comprises a tubular sleeve having a rear end which forms the rear end of the body, wherein the rear end of the sleeve comprises a rearward facing tapered portion configured to displace the front end of the gripping ring radially inwardly.

22. The connector of claim 21 wherein the gripping ring is axially offset from the rearward facing tapered portion in the rearward position.

23. The connector of claim 21 wherein the gripping ring contacts the rearward facing tapered portion in the forward position.

24. The connector of claim 1 wherein the inner surface of the compression ring comprises a forward facing tapered portion configured to displace the rear end of the gripping ring radially inwardly.

25. The connector of claim 24 wherein the gripping ring is axially offset from the forward facing tapered portion in the rearward position.

26. The connector of claim 24 wherein the gripping ring contacts the forward facing tapered portion in the forward position.

27. The connector of claim 1 wherein the outer surface of the tubular post at or near the rear end comprises a raised ridge.

28. The connector of claim 27 wherein the gripping ring is axially offset from the raised ridge in the rearward position.

29. The connector of claim 27 wherein at least part of the gripping ring surrounds the raised ridge in the forward position.

30. A connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a hollow body comprising a rear end, a front end, and an internal surface extending between the rear and front ends of the body, the internal surface defining a longitudinal hole;

a compression ring comprising a rear end, a front end surrounding the hollow body, and an inner surface defining a longitudinal hole extending between the rear and front ends of the compression ring;

a tubular post disposed at least partially within the longitudinal hole of the hollow body, the post comprising a tubular shank having a rear end, an inner surface and an outer surface, and wherein the outer surface of the tubular shank and the internal surface of the body define an annular cavity therebetween, wherein the inner surface is configured to allow the dielectric and the inner conductor to enter the shank and to allow the braided shield and the jacket to enter the annular cavity; and a deformable gripping ring disposed between the hollow body and the inner surface of the compression ring, the gripping ring comprising a rear end, a front end, an outer surface, and an inner surface;

wherein the cable extends through the compression ring, through the gripping ring, and into the hollow body, wherein the rear end of the shank is disposed between the braided shield and the dielectric, and part of the jacket and part of the braided shield are disposed in the annular cavity;

wherein the compression ring is axially movable over the hollow body between a rearward position and a forward position;

wherein, in the rearward position, the inner surface at the rear end of the gripping ring has a rear inner diameter, and the inner surface at the front end of the gripping ring has a front inner diameter; and wherein, in the forward position, the gripping ring is deformed by compression between the hollow body and the compression ring, the rear end of the gripping ring is displaced radially inwardly sufficient to reduce the rear inner diameter and to place the rear end of the gripping ring into contact with the jacket, and the front end of the gripping ring is displaced radially inwardly sufficient to reduce the front inner diameter and to place the front end of the gripping ring into contact with the jacket, wherein the jacket is sandwiched between the gripping member and the shank.

31. The connector of claim 30 wherein the gripping ring is deformed sufficiently to deform the jacket in the forward position.

32. The connector of claim 30 wherein the gripping ring forms a seal between the hollow body and the jacket in the forward position.

33. The connector of claim 30 wherein the gripping ring forms a seal between the compression ring and the jacket in the forward position.

34. The connector of claim 30 wherein the gripping ring forms a seal between the compression ring and the hollow body in the forward position.

35. The connector of claim 30 wherein, in the forward position, the gripping ring forms a seal simultaneously between the hollow body and the jacket, between the compression ring and the jacket, and between the compression ring and the hollow body.

36. The connector of claim 30 wherein the inner surface of the gripping ring does not contact the jacket in the rearward position.

37. The connector of claim 30 wherein, in the forward position, the inner surface of the gripping ring, from the rear end to the front end thereof, contacts the jacket of the cable.

38. The connector of claim 30 wherein, in the forward position, substantially all of the inner surface of the gripping ring contacts the jacket of the cable.

39. The connector of claim 30 wherein, in the rearward position, the end of the coaxial cable is disposed within the connector, wherein at least part of the inner conductor and at least part of the dielectric are disposed within the tubular shank, and wherein at least part of the outer conductor and at least part of the jacket are disposed in the annular cavity.

40. The connector of claim 39 wherein, in the forward position, at least a portion of the jacket and at least a portion of the outer conductor are sandwiched between the gripping member and the rear end of the tubular shank.

41. The connector of claim 40 wherein, in the forward position, the gripping member forms a seal between the jacket and the hollow body, thereby sealing the annular cavity.

42. The connector of claim 40 wherein, in the forward position, the gripping member forms a seal between the jacket and the compression ring.

43. The connector of claim 40 wherein, in the forward position, the gripping member forms a seal between the hollow body and the compression ring.

44. A combination of a coaxial cable and a connector for coupling an end of the coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a hollow body comprising a rear end, a front end, and an internal surface extending between the rear and front ends of the body, the internal surface defining a longitudinal hole;

a compression ring comprising a rear end, a front end surrounding the hollow body, and an inner surface defining a longitudinal hole extending between the rear and front ends of the compression ring;

a tubular post disposed at least partially within the longitudinal hole of the hollow body, the post comprising a tubular shank having a rear end, an inner surface and an outer surface, and wherein the outer surface of the tubular shank and the internal surface of the body define an annular cavity therebetween, wherein the inner surface is configured to allow the dielectric and the inner conductor to enter the shank and to allow the braided shield and the jacket to enter the annular cavity; and a deformable gripping ring disposed between the hollow body and the inner surface of the compression ring, the gripping ring comprising a rear end, a front end, an outer surface, and an inner surface;

wherein the cable extends through the compression ring, through the gripping ring, and into the hollow body, wherein the rear end of the shank is disposed between the braided shield and the dielectric, and part of the jacket and part of the braided shield are disposed in the annular cavity;

wherein the compression ring is axially movable over the hollow body between a rearward position and a forward position;

wherein, in the rearward position, the inner surface at the rear end of the gripping ring has a rear inner diameter, and the inner surface at the front end of the gripping ring has a front inner diameter;

wherein, in the forward position, the gripping ring is deformed by compression between the hollow body and the compression ring, the rear end of the gripping ring is displaced radially inwardly sufficient to reduce the rear inner diameter and to place the rear end of the gripping ring into contact with the jacket, and the front end of the gripping ring is displaced radially inwardly sufficient to reduce the front inner diameter and to place the front end of the gripping ring into contact with the jacket, wherein the jacket is sandwiched between the gripping member and the shank.

* * * * *